United States Patent [19]

Cho et al.

[11] Patent Number: 4,809,013

[45] Date of Patent: Feb. 28, 1989

[54] TELEVISION CONTEST-ENTERING DEVICE

[75] Inventors: Chiliang Cho; Antonio Cho; Viktor Cho, all of Zürich, Switzerland

[73] Assignee: Cope Praezisionsapparate AG, Zurich, Switzerland

[21] Appl. No.: 900,783

[22] Filed: Aug. 27, 1986

[30] Foreign Application Priority Data

Aug. 27, 1985 [EP] European Pat. Off. ..... 85110767.2

[51] Int. Cl.[4] ..... G01D 9/00

[52] U.S. Cl. ..... 346/19; 358/84

[58] Field of Search ..... 358/84, 296; 346/20, 346/53, 55, 19

[56] References Cited

U.S. PATENT DOCUMENTS

| | | | |
|---|---|---|---|
| 2,431,784 | 12/1947 | White | 346/19 |
| 3,307,197 | 2/1967 | Sandrick et al. | 346/20 |
| 4,122,498 | 10/1978 | Dyer | 346/20 |
| 4,644,368 | 2/1987 | Mutz | 346/53 |

FOREIGN PATENT DOCUMENTS

| | | | |
|---|---|---|---|
| 670159 | 9/1963 | Canada | 346/20 |

*Primary Examiner*—Clifford C. Shaw

*Attorney, Agent, or Firm*—Felfe & Lynch

[57] ABSTRACT

The invention relates to a television contest-entering device for the tamperproof recording and storing of entries in television contests. Such a handy device can be mailed, for example, to all interested televiewers before the program is broadcast, thus permitting these viewers to participate outside the television studio in a contest where the answers to questions asked in a quiz game, for example, are to be recorded with exact indication of the time at which they are recorded, and preserved in a tamperproof manner, the device then being returned by the contestant to the television station for judgment of the entries. The device in accordance with the invention, called Memorator, is characterized by a recording medium in the form of a paper tape which can be secured by a lock and which is combined with a synchronized time printer consisting of a computer, a quartz clock, a printing mechanism and a battery, the paper tape being accessible for the recording of the entries through a window over the paper tape; by a keybutton which can be depressed after the entries have been recorded on the paper tape to cause the clock time to be imprinted thereon and the paper tape to be advanced by means of a feed mechansim by a length corresponding to the area written on and into a section where the paper tape is secured by a lock; by a ratchet wheel with a check pawl which prevents backward motion of the feed mechansim after its forward motion; and by a safety lock which locks the cover, adapted to be flipped up, of the case of the recording medium.

10 Claims, 3 Drawing Sheets

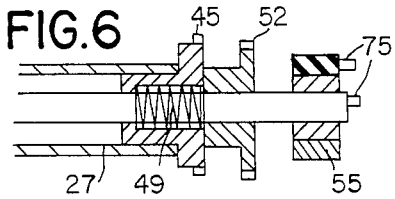
FIG.6
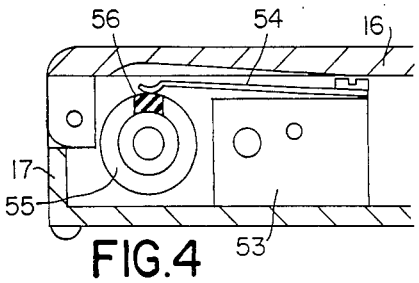
FIG.4
FIG.5
FIG.3
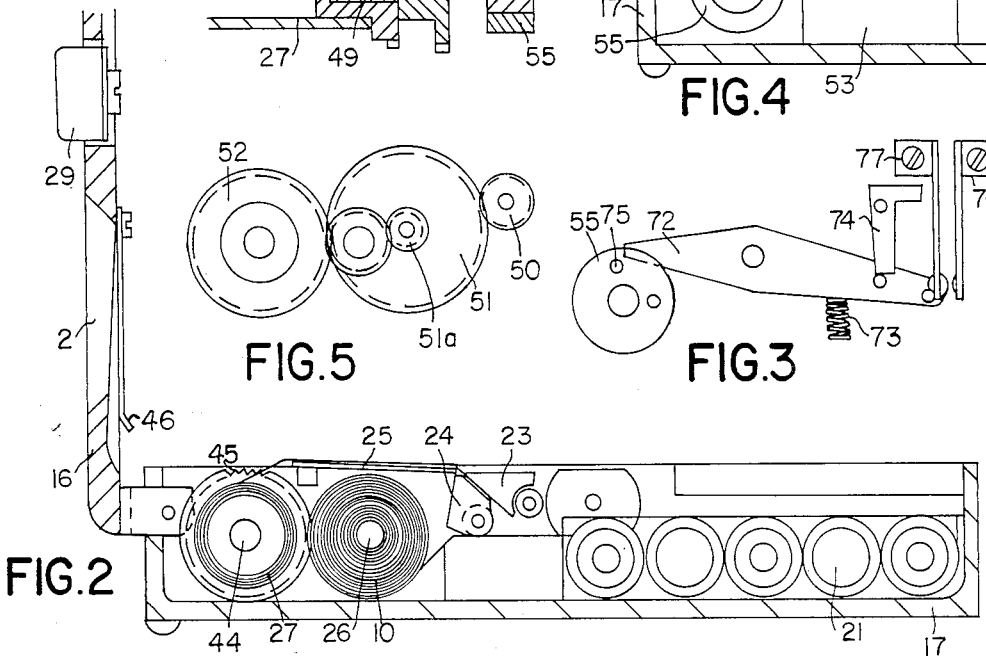
FIG.2
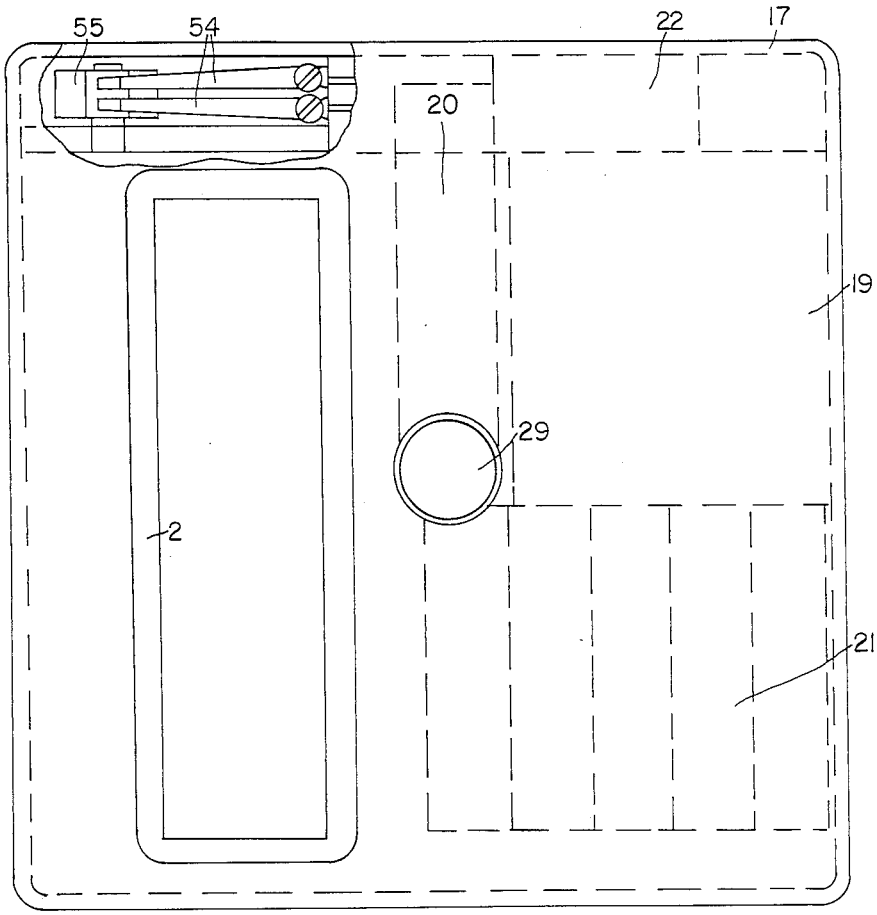
FIG.1

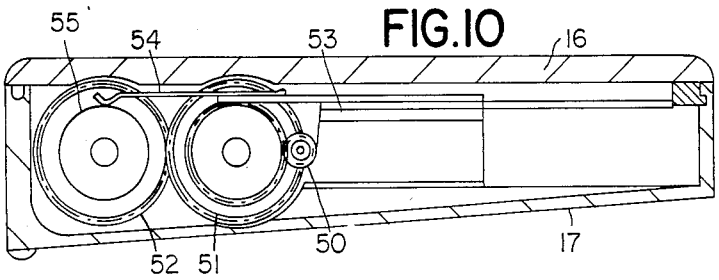
FIG.10
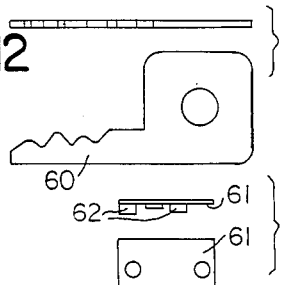
FIG.12
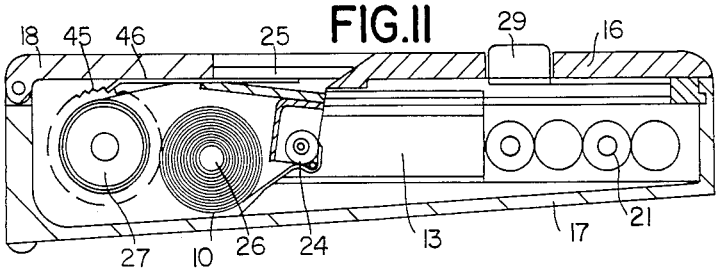
FIG.11
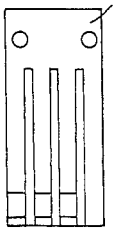
FIG.13
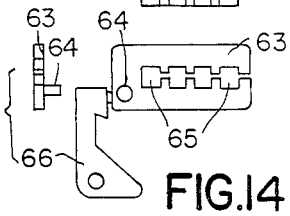
FIG.14
FIG.15
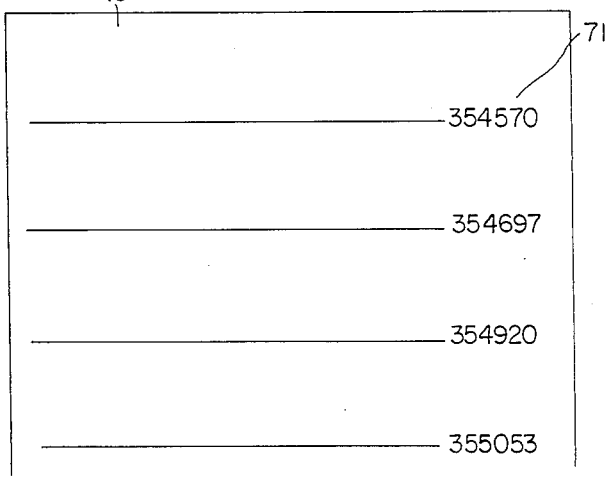
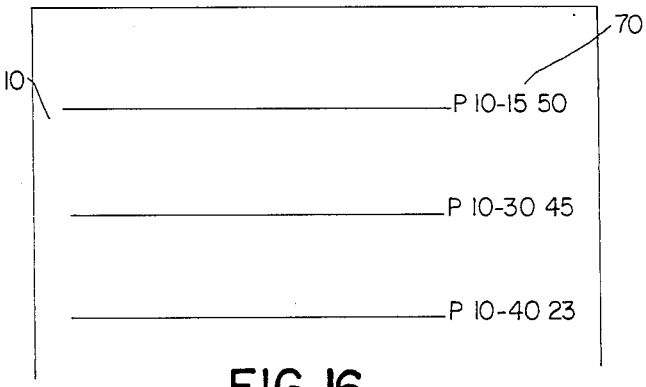
FIG. 16

TELEVISION CONTEST-ENTERING DEVICE

The invention relates to a television contest-entering device for the tamperproof recording and storing of entries in television contests, hereinafter called Memorator.

Like sports of all varieties, quizzes and other brainteasers have become increasingly popular on television. Unfortunately, active participation has been limited up to now to the small number of people who are invited to the television studio for the occasion. The viewing public at large has no opportunity to enter such television contests because there is no reliable means available at present outside the studio for verifying the entries. When the number of contestants is large, there is no practical way of establishing the chronological order in which the correct answers were entered, regardless of whether they were mailed in, phoned in or submitted by other means of communication.

For psychological reasons, active participation in a competition where prizes are awarded is much more challenging and exciting than passively watching the screen and at most enthusing over the feats of others. Besides, a contestant's interest will be stimulated all the more if he has the chance to find out while the show is still on the air whether his answer was true or false.

Television is an invaluable means of communication that reaches an exceedingly large segment of the population. It therefore makes sense to use this means of communication to encourage mental exercise and to gather and evaluate the results economically.

The object of the invention thus is to provide a device of the type mentioned at the outset which makes possible the direct participation in such contests, for example, quiz games, at low cost, of a television audience of any size, with each contestant recording his entry outside the television studio, clocking it and forwarding it to the television station without there being any possibility of cheating or of subsequent alteration of the entry.

This object is accomplished by the use of a recording medium in the form of a paper tape which can be secured by a lock and which is combined with a synchronized time printer consisting of a computer, a quartz clock, a printing mechanism and a battery for the recording of the contest entry, the paper tape being accessible for that purpose through a window over the paper tape, a keybutton being depressed, after the contest entry has been recorded on the paper tape, to imprint the clock time on the paper time and to advance the latter by means of a drive mechanism by a predetermined length corresponding to the area written on and into a secured zone of the recording medium, a ratchet wheel with a check pawl preventing backward motion of the drive mechanism after its forward motion, and a safety lock securing the cover of the case of the recording medium, which is adapted to be flipped up.

Such Memorators are small, handy devices which are mailed to interested televiewers before the program is broadcast and which enable every viewer to record his answers at home, while the contest is in progress, with tamperproof synchronous printed indication of the time directly on a paper tape, which then is advanced, secured against alteration, into a section of the case of the recording medium that is not accessible from the outside, except to the television station itself. After the contest has ended and the locked cases have been returned to the television station or to another agency designated to collect them, the television station can have them opened, possibly under notarial supervision, to judge the entries recorded on the paper tape. This device, and the paper tape which it contains, thus are tamperproof.

The principle on which the invention is based thus is a paper tape which can be secured by a lock and which is combined with a synchronized time printer or a synchronized time marker, can be advanced stepwise but is prevented by a ratchet wheel with a check pawl from being moved backward, and is provided with two columns, for example, one for indication of the time and the other for recording of the contest entries, for example, the answers in a quiz game, which can be recorded by the contestant through a window in the cover of the case of the recording medium. On completion of an entry, the contestant presses a keybutton, the paper tape then being advanced by a predetermined length by means of a drive mechanism and thus moved into a locked section of the case. Subsequent correction by the contestant of the recorded entry and of the printed time indication is prevented since the cover of the case is locked and can only be opened by the television station which sent out the Memorator, and which then collects the entries and determines the winner of the contest.

Further advantageous features of the invention will become apparent from the dependent claims.

The invention will now be described in greater detail with reference to the embodiments illustrated in the accompanying drawings, wherein:

FIG. 1 is a top plan view of a Memorator;

FIG. 2 is a cross-sectional side elevation of the Memorator, with the cover of the case opened;

FIG. 3 is a diagrammatic representation of the subtotal mechanism used in the Memorator;

FIG. 4 is a cross-sectional view of the contact mechanism;

FIG. 5 is a side elevation of the transmission gearing used;

FIG. 6 is a longitudinal section of the take-up spool with the contact disk;

FIG. 10 is a cross-sectional side elevation of a further embodiment of the Memorator;

FIG. 11 is a further cross-sectional side elevation of the Memorator of FIG. 10;

FIGS. 12, 13 and 14 are top plan views of punched sheet-metal parts of the safety lock for the Memorator;

FIG. 15 is a top plan view of a length of paper tape with indication of the standard time in seconds; and FIG. 16 is a top plan view of a length of paper tape with normal time indication.

Figure 7:
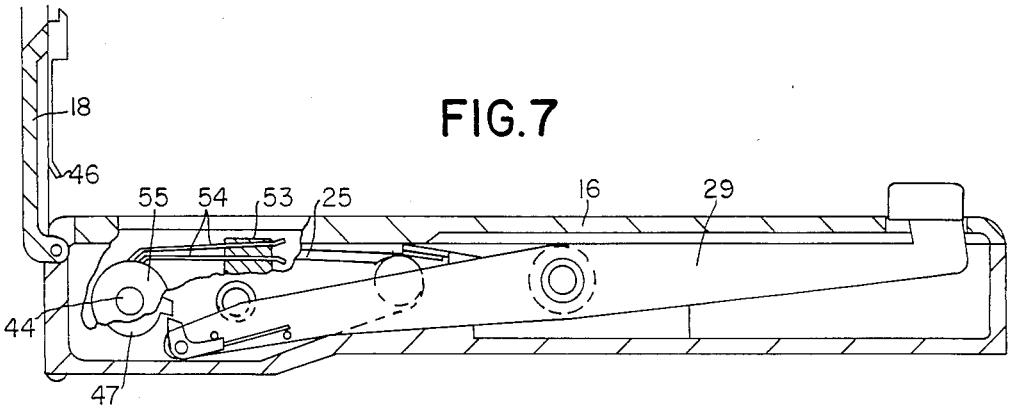
FIG. 7 is a cross-sectional side elevation of another embodiment of the Memorator with the cover of the case opened.

The Memorator illustrated in the drawings is assembled from six elements, namely, a clock 22, a computer 19, a printing mechanism 20, a paper-tape drive mechanism 26 and 27, and a battery 21 as well as a safety lock 60 to 66. It forms a handy, flat device of about the size shown in the drawings. Such a device can be mailed to all interested televiewers before a program is broadcast which involves the participation by viewers not present in the television studio in a contest where specific questions just be answered within a given time, these questions being answered by the contestants gathered in the television studio directly, and by the contestants sitting at home in front of their television sets indirectly, by means of the device here described, and more particularly by preparing a tamperproof written record of the answers with synchronously imprinted indication of the time, which at the conclusion of the contest remains within the device and is then returned together with the device, by mail, for example, to the television studio for judging or to another agency appointed for the purpose.

The basic principle of the Memorator thus is a recording or paper tape 10, or a storage disk, which can be secured by a lock and which is combined with a synchronized time printer or with a synchronized time marker, and which can be advanced stepwise but because of an internal ratchet wheel and check pawl cannot be moved backward after it has been advanced, so that after the length of paper tape which has been written on has been advanced it is preserved in a tamperproof manner within the case of the recording medium.

The paper tape 10 has two columns, one for the time indication and the other for the contest entry, which can be jotted down by hand on the paper tape 10 through a window 2 and will then remain visible until a keybutton 29 is pressed, which causes the paper tape to be moved forward by a predetermined length by means of a drive mechanism and into the locked section of the device. Any subsequent correction by the contestant of the recorded answers or of the time imprint is thus prevented.

Figure 8:
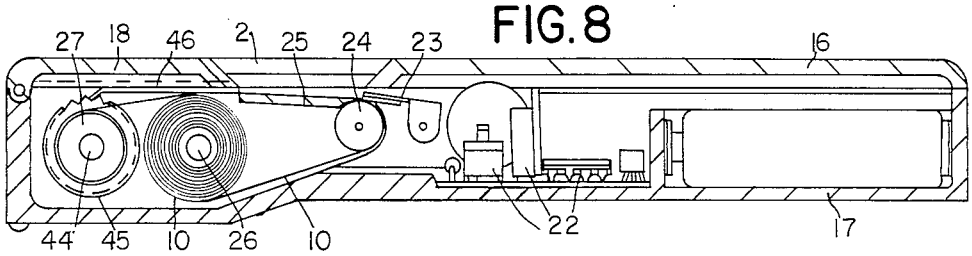
FIG. 8 is a side elevation corresponding to FIG. 7 of said other embodiment of the Memorator.
Figure 9:
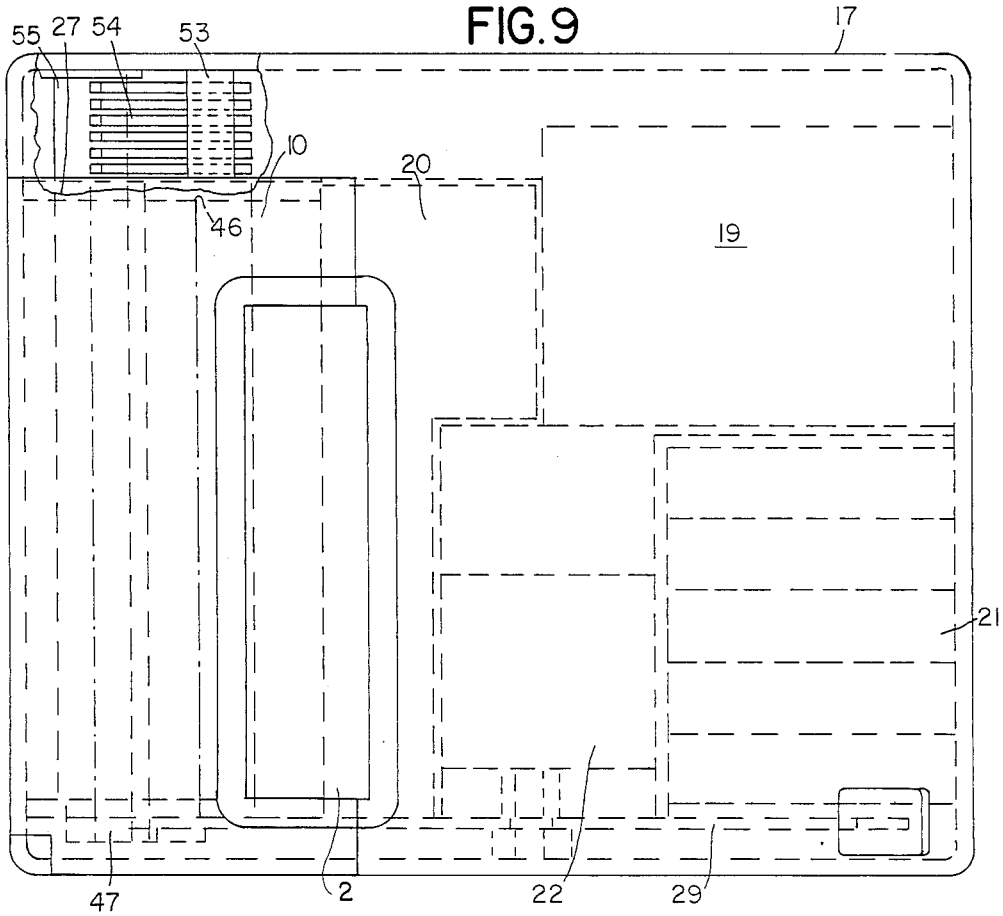
FIG. 9 is a top plan view of the Memorator of FIGS. 7 and 8.

A quartz clock 22 shown in FIG. 8 cooperates with a conventional electronic computer 19 and with a printer 20. The 1-Hz pulses generated by the crystal oscillator through a frequency divider are transmitted to the computer, each as a numerical unit per second +1, and when the keybutton 29 is pressed, the subtotal mechanism of the computer is cut in so that the cumulative time or second counts are imprinted on the paper tape 10 by the printing mechanism or printer 23.

The quartz clock may also be integrated with a microprocessor and the time outputted as a computer printout.

The paper feed mechanism comprises the paper tape 10, also referred to as recording tape, which is wound onto a shaft 26. The end of the paper tape runs over a roller 24 to the printer 23 and from there over a writing platen 25 to a take-up spool 27, which through transmission gears 50, 51, 51*a* and 52 is in operative engagement with a motor drive. The paper tape has two columns, one column being used for indication of the time and the other to record the contest entries, the latter column being accessible through the window 2 for writing on the paper tape 10, that is, for recording the contest entries. After completing an entry, the contestant presses the keybutton 29, which causes the seconds count to be imprinted on the paper tape 10. At the same time, the tape is wound by a corresponding length onto the take-up spool 27, which is rotated by the motor drive by a line spacing. A contact disk 55 mounted on a shaft 44 cooperates with two contact springs 54 for the paper-feed circuit. At that instant, the insulating leaf 56 of the contact disk is out of contact with the contact springs 54 and contact is reestablished for the paper-feed circuit, the take-up spool 27 being rotated a complete revolution before the insulating leaf 56 again passes under the two contact springs 54, the paper tape 10 then being advanced by a desired length.

The take-up spool 27 is joined to a ratchet wheel 45. Fastened to the cover of the case is a check pawl 46 which prevents backward motion of the take-up spool 27 when the cover is closed. The quartz clock and computer and the printing mechanism are powered by batteries 21. The parts 72 to 77 form a subtotal mechanism which cooperates with a contact disk 55. During a paper advance, a trip lever 72 is cocked against the force of a spring by means of two pins 75 mounted on the contact disk 55 and held by means of a check pawl 74. With each actuation of the keybutton 29, the check pawl 74 is released and the lever 72 pivoted back against the spring 73, and the subtotal contacts 76 and 77 momentarily touch. As the lever 72 returns, the subtotal contacts are separated by means of a special cam mechanism.

However, the entries might also be stored in the Memorator electronically, with synchronous time indication, other storage medium built into it, subsequently to be used by the television studio for evaluation.

To prevent cheating, the Memorator is provided with a safety lock. Unlike the usual cylinder locks with cylindrical barrel, cylindrical plug and cylindrical pin tumblers, this safety lock essentially consists of only three punched sheet-metal parts and therefore is considerably cheaper. This novel safety lock comprises a fingerlike tumbler 61, fabricated from spring strip steel, with cams 62 of varying heights and a bolt 63 which is provided with square holes 65 interconnected by narrow slots as counterlocking elements. In the closed state, the points of the tumbler rest on the base of the square holes so that the bolt 63 remains locked. When a key that is held in safekeeping by the television station which distributes or mails the individual devices after they have been locked and readied for mailing is inserted, the varying heights of the serrations are balanced out by the corresponding heights if the cams on the tumbler, the bolt 63 thus being released. The key can now be pushed along with the bolt against the latch 66, thus permitting the cover 16 to be reopened after the device has been returned by the contestant to the television station for verification of the recording which it contains, and hence for judgment of the entries.

We claim:

1. A television contest-entering device for the tamperproof recording and storing of entries in television contests, comprising: a recording medium in the form of paper tape (10) and having a zone secured by a lock and which is combined with a time printer comprising a computer (19), a quartz clock (22), a printing mechanism (20, 23, 24) and a battery (21) for the recording of the contest entry, the paper tape (10) being accessible for the written recording of the contest entry on an area through a window (2) over it; a keybutton (29) which can be depressed, after the contest entry has been recorded on the paper tape (10), for imprinting on the latter the clock time and for advancing the paper tape (10) by means of a feed mechanism (44–56) by a length corresponding to the area written on and into a secured zone of the recording medium; a ratchet wheel (45) with a check pawl (46) which prevents backward motion of the feed mechanism after its forward motion; and a safety lock which secures a cover (16), adapted to be flipped up, of the case of the recording medium.

2. A device according to claim 1, which includes a computer printer (19, 20) and quartz clock (22) as time printer, and in which the quartz clock through a frequency divider generates 1-Hz pulses (22) being transmitted every second as numerical units (1) to the computer, and in which the computer includes a subtotal mechanism which can be tripped by pressing the keybutton (29) so that the cumulative time units are imprinted on the paper tape (10) as a total representing the total seconds count.

3. A device according to claim 1, which includes a computer printer as time printer, the clock being integrated with a microprocessor of the computer and the time being outputted by computer printout.

4. A device according to claim 1, which includes a computer printer so that the paper tape (10) runs off a supply spool (26), over a roller (24), past the printer (23) and over a platen (25) disposed beneath the window (2) and serving as a writing surface, and then onto a take-up spool (27), the contest entry being recordable on the paper tape (10) together within the time.

5. A device according to claim 4, in which the take-up pool (27) is rotatably mounted together with the ratchet heel (45) on a shaft (44) on which a transmission gear (52) is mounted, and that these are adapted to be held in operative engagement by the action of a spring (49).

6. A device according to claim 5, in which when the cover (16) is closed, backward motion of the ratchet wheel (45) and of the take-up spool (27) is prevented by a check pawl (46) which is attached to the cover (16).

7. A device according to claim 5, which includes a contact disk (55) mounted on the shaft (44) and which makes contact with two contact springs (54) while the paper tape is advancing and which by means of a narrow insulating leaf (56) breaks contact to stop the advancement of the paper tape.

8. A device according to claim 1, which includes a transmission gear (52) in operative engagement, through intermediate gears (**50, 51, 51*a*), with a motor drive for the advancement of the paper tape (10**).

9. A device according to claim 1 in which the keybutton (29) is provided with an automatic momentary-action circuit (72–77).

10. A device according to claim 1, which includes tumblers (61, 63) of the safety lock which are punched out of sheet metal.

* * * * *

UNITED STATES PATENT AND TRADEMARK OFFICE

CERTIFICATE OF CORRECTION

PATENT NO. : 4,809,013

DATED : February 28, 1989

INVENTOR(S) : Chiliang Cho, et al.

It is certified that error appears in the above-identified patent and that said Letters Patent is hereby corrected as shown below:

On the title page

In the heading [73] Assignee:

for "Cope Praezisionsapparate AG"

read -- Copo Praezisionsapparate AG --.

Column 3, line 1 for "just" read -- must --.

Column 4, line 37 for "if" read -- of --.

Column 5, line 20 for "pool" read -- spool --.

Column 5, line 21 for "heel" read -- wheel --.

Signed and Sealed this

Twenty-ninth Day of August, 1989

*Attest:*

*Attesting Officer*

DONALD J. QUIGG

*Commissioner of Patents and Trademarks*